US011840834B2

(12) United States Patent
Mason et al.

(10) Patent No.: US 11,840,834 B2
(45) Date of Patent: Dec. 12, 2023

(54) LINKING DEVICE

(71) Applicant: Illinois Tool Works Inc., Glenview, IL (US)

(72) Inventors: Greg Stephen Mason, Brisbane (AU); Ryan Rogers, Glenview, IL (US); David Barnes, Manly (AU)

(73) Assignee: Illinois Tool Works Inc., Glenview, IL (US)

( * ) Notice: Subject to any disclaimer, the term of this patent is extended or adjusted under 35 U.S.C. 154(b) by 87 days.

(21) Appl. No.: 17/435,934

(22) PCT Filed: Mar. 5, 2020

(86) PCT No.: PCT/US2020/021188
§ 371 (c)(1),
(2) Date: Sep. 2, 2021

(87) PCT Pub. No.: WO2020/181085
PCT Pub. Date: Sep. 10, 2020

(65) Prior Publication Data

US 2022/0145615 A1 May 12, 2022

(30) Foreign Application Priority Data

Mar. 7, 2019 (AU) ..... 2019900766
Mar. 2, 2020 (AU) ..... 2020201536

(51) Int. Cl.
*E04B 1/48* (2006.01)
*E04C 5/16* (2006.01)

(52) U.S. Cl.
CPC ..... *E04B 1/483* (2013.01); *E04C 5/168* (2013.01)

(58) Field of Classification Search
CPC ..... E04B 1/483; E04C 5/168
See application file for complete search history.

(56) References Cited

U.S. PATENT DOCUMENTS 3,694,012 A 9/1972 Gelfand
5,497,592 A * 3/1996 Boeshart ..... E04G 17/0654 249/43

(Continued)

FOREIGN PATENT DOCUMENTS

DE 20317897 U1 3/2004
EP 0622575 B1 5/1996

(Continued)

OTHER PUBLICATIONS

International Search Report and Written Opinion from International Patent Application No. PCT/US2020/021188, dated Jun. 9, 2020 (10 pages).

(Continued)

*Primary Examiner* — Andrew J Triggs
(74) *Attorney, Agent, or Firm* — Neal, Gerber & Eisenberg LLP

(57) ABSTRACT

A device for linking separate members of a dowel cradle, comprising a bar; and at least two couplings, located on the bar. A dowel cradle comprising: at least one load transfer dowel; a basket having a pair of elongate members spaced apart from each other to support the load transfer dowel thereon; a device comprising: a bar located between the two elongate members of the basket; and at least two couplings located on the bar, each coupling being attached to a respective one of the elongate members of the basket.

18 Claims, 4 Drawing Sheets

(56) References Cited

U.S. PATENT DOCUMENTS

| | | | | |
|---|---|---|---|---|
| 5,792,527 | A * | 8/1998 | Yoshimitsu | E04G 17/06 428/36.1 |
| 6,899,310 | B1 * | 5/2005 | Trangsrud | E04C 5/168 248/68.1 |
| 7,481,031 | B2 | 1/2009 | Boxall et al. | |
| 7,568,320 | B2 * | 8/2009 | Paterson | E04B 1/4178 52/282.4 |
| 7,637,689 | B2 | 12/2009 | Boxall et al. | |
| 7,716,890 | B2 | 5/2010 | Boxall et al. | |
| 8,322,109 | B2 * | 12/2012 | Trangsrud | E04C 5/162 52/685 |
| 8,511,935 | B1 * | 8/2013 | Thomas | E01C 11/14 404/136 |
| 9,145,695 | B2 * | 9/2015 | Ciuperca | E04C 5/07 |
| 9,982,445 | B2 * | 5/2018 | Ciuperca | E04B 1/38 |
| 10,280,568 | B2 * | 5/2019 | McDonald | E01C 11/14 |
| 10,443,194 | B2 * | 10/2019 | McDonald | E01C 11/06 |
| 10,837,144 | B2 | 11/2020 | Rodden et al. | |
| 10,870,985 | B2 | 12/2020 | Rodden | |
| 2015/0013262 | A1 | 1/2015 | Wilkes et al. | |
| 2018/0195240 | A1 | 7/2018 | McDonald | |
| 2020/0407924 | A1 | 12/2020 | Rodden | |
| 2022/0145615 | A1 * | 5/2022 | Mason | E01C 11/14 |

FOREIGN PATENT DOCUMENTS

| | | |
|---|---|---|
| EP | 3323937 | 5/2018 |
| WO | 2006016133 A1 | 2/2006 |

OTHER PUBLICATIONS

European Office Action from European Application No. 20714823.0, dated Apr. 5, 2023 (4 pages).

* cited by examiner

LINKING DEVICE

PRIORITY

This application claims priority to and the benefit of Australian Patent Application No. 2019900766, filed Mar. 7, 2019, and Australian Patent Application No. 2020201536, filed Mar. 2, 2020, the entire contents of both of which are incorporated herein by reference.

FIELD OF THE INVENTION

The present invention relates to a linking device and more particularly, but not exclusively, to a clip-on frangible travel bar for linking a frame or basket of a dowel cradle to be embedded for support within concrete.

BACKGROUND OF THE INVENTION

A dowel cradle is a known apparatus responsible for the transfer of load between adjacent concrete slabs. This apparatus appears in US20181596789 and in US20150013262A1. When a concrete slab is placed and begins to cure, the volume of the concrete will shrink, and due to concrete's low strength under tensile loading, random cracking will occur. To avoid this, the cracks are induced in controlled locations using a saw; however, a slab made up of multiple sections can result in unwanted deflections under heavy loading. Dowel cradles prevent deflection, by transferring loading from one slab section to the next. A dowel cradle supports a plurality of dowels through the use of a basket. They are placed prior to the pouring of concrete, and are embedded in the concrete once it has set, the dowels located at the induced joints within the slab.

A key feature of the dowel cradle is the metallic member which runs parallel to the dowels, connecting the main elongate members of the basket. The purpose of the bar is to ensure rigidity of the apparatus during transportation; however its usage reveals certain deficiencies in the dowel cradle design. In order to link the longitudinal members of the basket, the metallic bar is welded onto the cradle, raising the costs and manufacturing time of the apparatus. Furthermore, the welding process, which is performed manually, can result in the edges of the metallic bar protruding past the elongate members of the basket, creating a potential safety hazard. Once the dowel cradle is placed, the metallic bar needs to be cut, so that after the concrete has been poured and has set, the dowel cradle is able to move freely. Bars which are accidentally left uncut are frequently cited as the cause of unwanted parallel cracking in concrete slabs.

The present invention seeks to alleviate these problems by providing a simple to use and cost effective solution, in the form of a plastic bar that does not require welding or cutting.

SUMMARY OF THE INVENTION

There is provided a device for linking separate members of a dowel cradle, comprising of a bar and at least two couplings. The separate members may be the main elongate members of the dowel cradle.

Preferably, the at least two couplings are in the form of clipping components.

More preferably, the clipping components take the form of resilient clips.

Preferably, the at least two couplings are mutually spaced by a length of bar, with the length of bar including a frangible portion which is configured to stretch or break under tension applied in a longitudinal direction of the bar.

More preferably, the at least two couplings comprise a first and second coupling, where the first coupling is located at one end of the bar, and the second coupling is located at the other end of the bar.

Preferably, the clipping components are formed so as to clip onto the main elongate members of a dowel cradle basket.

Preferably, the bar is provided with a plurality of gripping ribs. The gripping ribs perform the function of concrete anchoring restraints.

Preferably, the cross sectional shape of the bar is in the form of a cross and comprises of a plurality of frangible planar members.

Preferably, the device is formed from polypropylene.

There is also provided a dowel cradle, comprising at least one load transfer dowel, a basket having a pair of elongate members spaced apart from each other to support the load transfer dowel thereon, a device comprising a bar located between the two elongate members of the basket and at least two couplings located on the bar, each coupling for attaching to a respective one of the elongate members of the basket. Each coupling may be in the form of a clipping component.

BRIEF DESCRIPTION OF THE DRAWINGS

The invention is described, by way of non-limiting example only, with reference to the accompanying drawings, in which.

DETAILED DESCRIPTION

Figure 1:
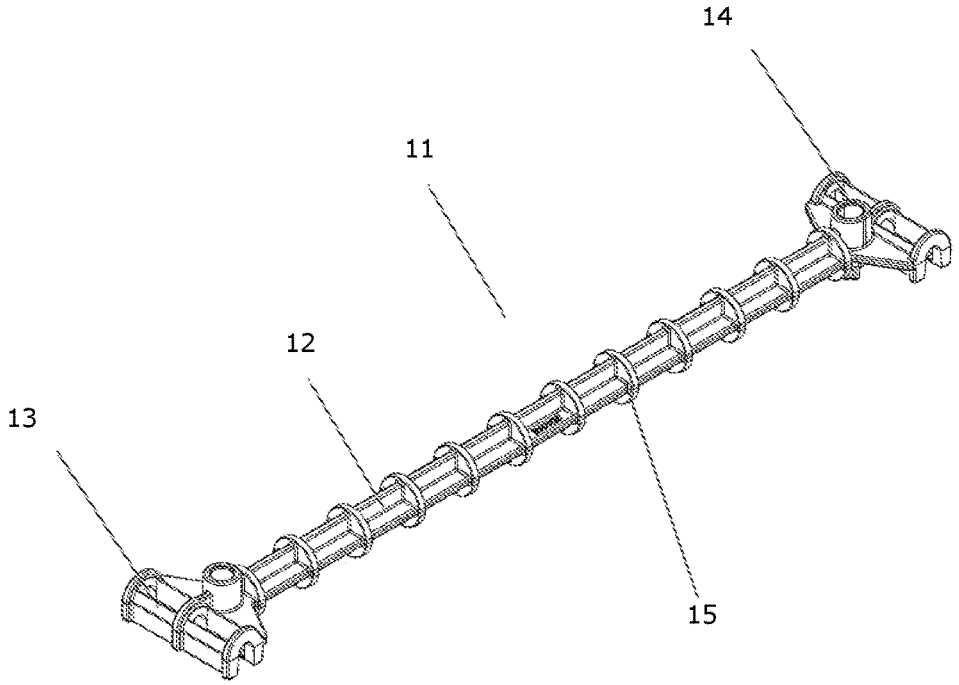
FIG. 1 is a diagrammatic perspective view of the linking device.
Figure 2:
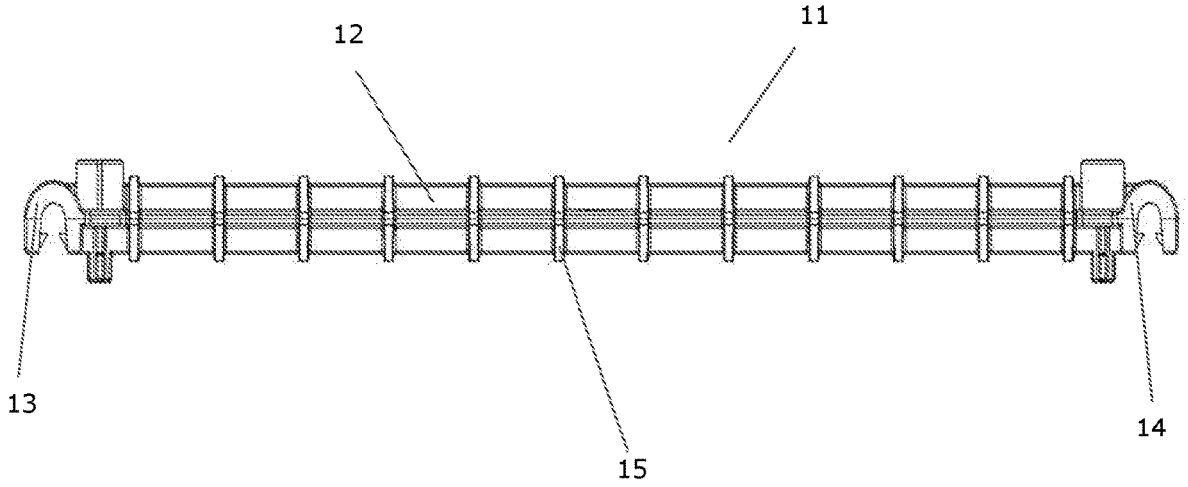
FIG. 2 is a diagrammatic side view of the linking device.

With reference to FIGS. 1 and 2, a linking device, depicted in the embodiment in the form of a clip-on frangible travel bar 11 is provided for linking the main elongate members of a dowel cradle. The clip-on frangible travel bar 11 comprises of a bar 12 and couplings 13 and 14, the couplings taking the form of clipping components and more specifically, resilient clips. Coupling 13 is located at one end of the bar 12 and coupling 14 is located on the other end of the bar 12, with the section of bar between the two couplings intended to become severed to allow for unrestricted movement of the dowel cradle, once it is embodied within concrete. The bar is provided with a plurality of gripping ribs 15 which are equally spaced over the length of the bar, performing the function of concrete anchoring restraints. These restraints will prevent longitudinal deflection of the bar while the concrete sets, promoting the fracture of the bar under contraction/expansion of the concrete.

Figure 3:
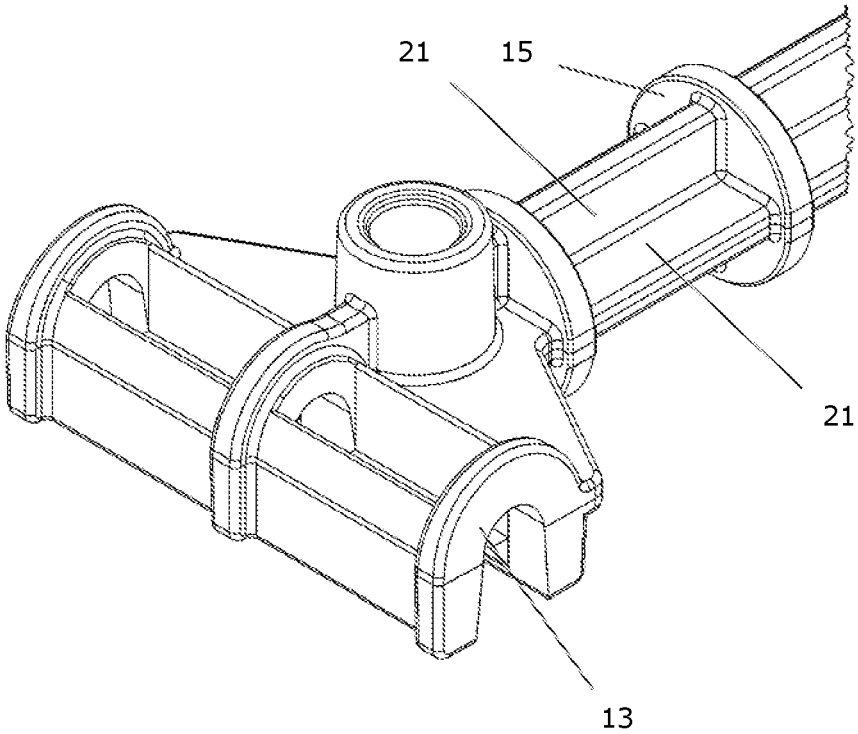
FIG. 3 is a diagrammatic perspective view of the linking device, zoomed to show the clipping component in detail.

FIG. 3 shows diagrammatically the coupling of the invention, and how it is incorporated in relation to the remainder of the bar. The view also reveals a possible embodiment of the cross-sectional shape of the bar, in this instance a cross, comprising multiple frangible planar members 21, intended to fracture under the contraction of the concrete as the concrete dries. At a certain portion of the bar, the cross-sectional profile may be reduced to ensure consistent fracture at a specific point along the bar. The coupling 13 is formed such that it is able to easily clip onto the main elongate member of a dowel cradle. The coupling 14 is also formed with this function in mind. The coupling comprises the end of the bar as depicted in FIG. 3, up to the first rib.

Figure 4:
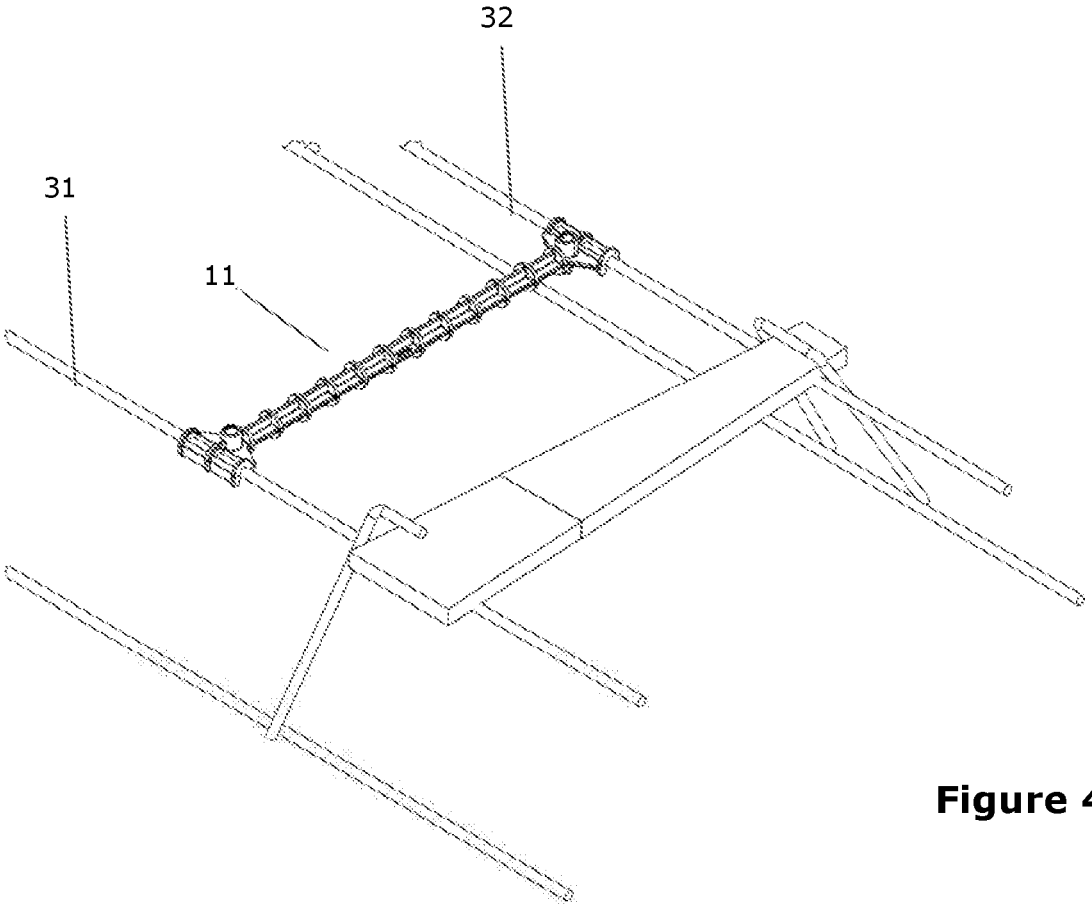
FIG. 4 is a diagrammatic perspective view of the linking device clipped onto the main elongate members of a dowel cradle basket.
Figure 5:
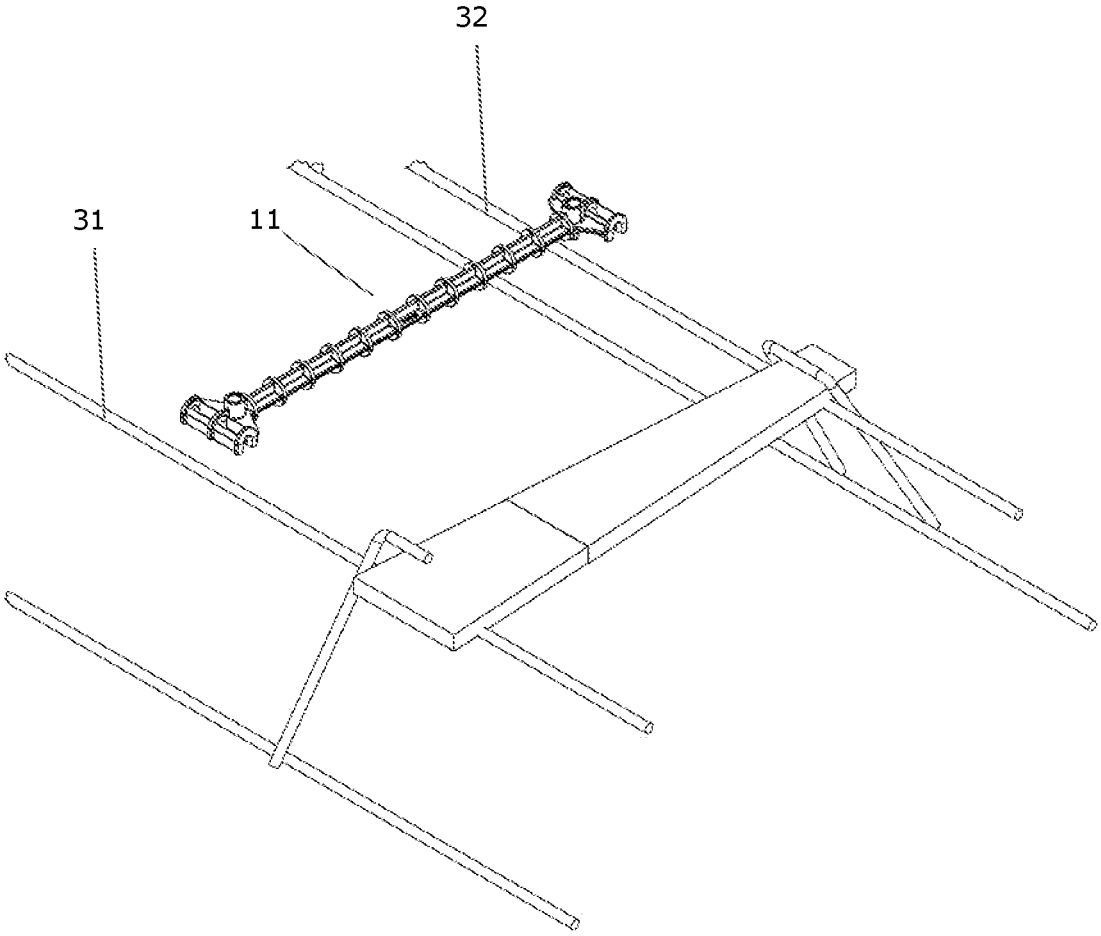
FIG. 5 is a diagrammatic perspective view of the linking device detached from the main elongate members of a dowel cradle basket.

FIGS. 4 and 5 depict an intended embodiment of the invention, namely used in conjunction with a dowel cradle. The clip-on frangible travel bar connects to the main elongate members of the dowel cradle basket 31 and 32, keeping the elongate members in tension and compression, consequently maintaining the required shape of the dowel cradle during transport and setup. The bar is easily attached and removed from the dowel cradle, eliminating any need for welding, which is typically performed manually, hence lowering production costs.

Figure 6:
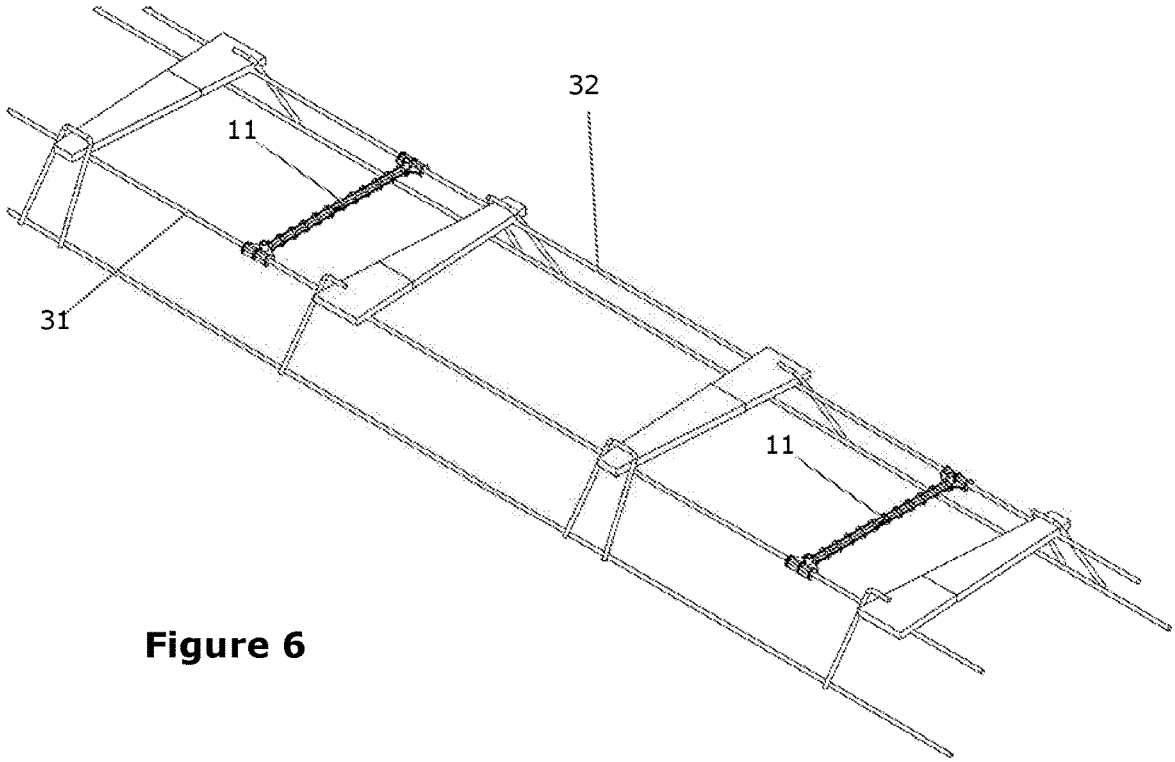
FIG. 6 is a diagrammatic perspective view of multiple linking devices clipped onto the main elongate members of a dowel cradle basket.

FIG. 6 shows diagrammatically a plurality of clip-on frangible travel bars, fixed onto the longitudinal members of a dowel cradle. Considering the portability of the invention, these travel bars are easily used in large applications of dowel cradles. Since the clip-on frangible travel bars do not require to be cut, on-site productivity in large scale implementation is improved immensely.

Figure 7:
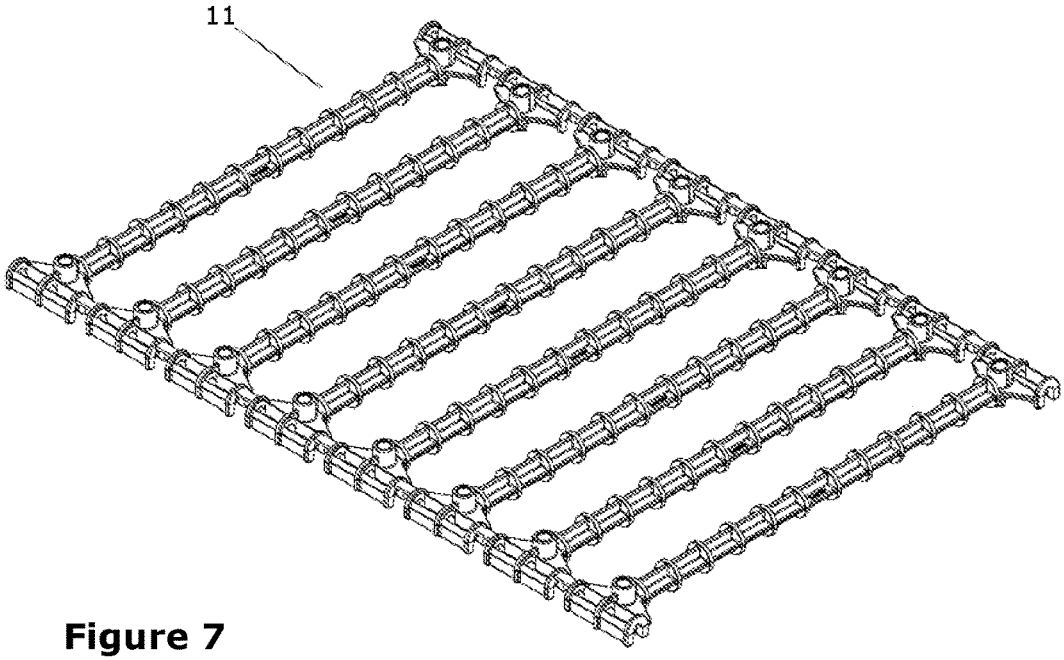
FIG. 7 is a diagrammatic perspective view of multiple linking devices.

FIG. 7 shows diagrammatically a plurality of clip-on frangible travel bars. These bars are formed as one piece in a plastic injection mould and are easily reproducible. The proposed material for the device is polypropylene, which may be of the kind marketed with the branding Bormod™ BH975MO. BH975MO is a heterophasic copolymer with the following physical properties:

| Property | Typical Value | Test Method |
|---|---|---|
| Density | 900-910 kg/m$^3$ | ISO 1183 |
| Melt Flow Rate (230° C./2.16 kg) | 38 g/10 min | ISO 1133 |
| Tensile Modulus (1 mm/min) | 1500 MPa | ISO 527-2 |
| Tensile Strain at Yield (50 mm/min) | 4% | ISO 527-2 |
| Tensile Stress at Yield (50 mm/min) | 25 MPa | ISO 527-2 |
| Heat Deflection Temperature (0.45 N/mm$^2$)* | 96° C. | ISO 75-2 |
| Charpy Impact Strength, notched (23° C.) | 8 kJ/m$^2$ | ISO 179/1Ea |
| Charpy Impact Strength, notched (−20° C.) | 4.5 kJ/m$^2$ | ISO 179/1Ea |
| Hardness, Rockwell (R-scale) | 86 | ISO 2039-2 |

This grade of heterophasic copolymer is characterized by an optimum combination of very high stiffness, good flow properties and good impact strength, making it highly suitable for its usage in the present invention. The material can be colour coded to indicate the dowel type to be used in conjunction with the bar.

It will be appreciated that the linking device will not always necessarily break, but the stretch or elongation of the linking device will be sufficient to activate the dowel cradle and also eliminate any potential restraint at the joint. In other words, the length of bar is configured to fail under tension applied.

While various embodiments of the present invention have been described above, it should be understood that they have been presented by way of example only, and not by way of limitation. It will be apparent to a person skilled in the relevant art that various changes in form and detail can be made therein without departing from the spirit and scope of the invention. Thus, the present invention should not be limited by any of the above described exemplary embodiments.

Throughout this specification and the claims which follow, unless the context requires otherwise, the word "comprise", and variations such as "comprises" and "comprising", will be understood to imply the inclusion of a stated integer or step or group of integers or steps but not the exclusion of any other integer or step or group of integers or steps.

The reference in this specification to any prior publication (or information derived from it), or to any matter which is known, is not, and should not be taken as an acknowledgment or admission or any form of suggestion that that prior publication (or information derived from it) or known matter forms part of the common general knowledge.

The invention claimed is:

1. A dowel cradle linking device for linking separate members of a dowel cradle, the device comprising:

a bar; and at least two couplings located on the bar, the couplings removably attachable onto the separate members of the dowel cradle, wherein the at least two couplings are spaced apart by a length of the bar, and the length of the bar includes a frangible portion breakable under tension applied in a longitudinal direction of the bar.

2. The dowel cradle linking device of claim 1, wherein each of the couplings includes a clipping component.

3. The dowel cradle linking device of claim 2, wherein each clipping component includes a resilient clip.

4. The dowel cradle linking device of claim 1, wherein the at least two couplings includes a first coupling located at one end of the bar.

5. The dowel cradle linking device of claim 4, wherein the at least two couplings includes a second coupling located at an opposite end of the bar.

6. The dowel cradle linking device of claim 1, wherein the bar includes a plurality of gripping ribs.

7. The dowel cradle linking device of claim 6, wherein each gripping rib includes a flange extending transversely outwardly from the bar.

8. The dowel cradle linking device of claim 6, wherein the gripping ribs are positioned at spaced intervals along the bar.

9. The dowel cradle linking device of claim 1, wherein a cross-section of the bar is of a cross shape and the bar includes a plurality of frangible planar members.

10. The dowel cradle linking device of claim 1, which is formed of polypropylene.

11. A dowel cradle comprising:

at least one load transfer dowel;

a basket having two elongate members spaced apart from each other to support the load transfer dowel; and a linking device comprising:

a bar located between the two elongate members of the basket, and at least two couplings located on the bar, each coupling being attached to a respective one of the elongate members of the basket, wherein the at least two couplings are spaced apart by a length of the bar, and the length of the bar includes a frangible portion breakable under tension applied in a longitudinal direction of the bar.

12. The dowel cradle of claim 11, wherein each of the couplings includes a clipping component.

13. The dowel cradle of claim 12, wherein each clipping component includes a resilient clip.

14. The dowel cradle of claim 11, wherein the bar includes a plurality of gripping ribs.

15. The dowel cradle of claim 11, wherein a cross-section of the bar has a cross shape.

16. The dowel cradle of claim 15, wherein the bar includes a plurality of frangible planar members.

17. The dowel cradle of claim 11, wherein the elongate members of the basket are spaced apart to support opposite end portions of the load transfer dowel, a first one of the elongate members configured to support one end portion of the load transfer dowel and a second one of the elongate members configured to support an opposite end portion of the load transfer dowel.

18. The dowel cradle of claim 11, wherein the linking device is formed of polypropylene.

* * * * *